US005438828A

United States Patent [19]

Fukae

[11] Patent Number: 5,438,828

[45] Date of Patent: Aug. 8, 1995

[54] MANIFOLD TYPE CATALYTIC CONVERTER ARRANGEMENT

[75] Inventor: Yasuo Fukae, Tokyo, Japan

[73] Assignee: Calsonic Corporation, Tokyo, Japan

[21] Appl. No.: 124,400

[22] Filed: Sep. 21, 1993

[30] Foreign Application Priority Data

Sep. 21, 1992 [JP] Japan ..... 4-065650 U

[51] Int. Cl.[6] ..... F01N 3/28

[52] U.S. Cl. ..... 60/302; 60/322; 60/323

[58] Field of Search ..... 60/302, 322, 323

[56] References Cited

U.S. PATENT DOCUMENTS 4,261,170 4/1981 Suzuki ..... 60/302
4,383,410 5/1983 Kimura ..... 60/302
5,265,420 11/1993 Rutschmann ..... 60/302
5,271,477 12/1993 Gekka ..... 60/302

FOREIGN PATENT DOCUMENTS 2913731 10/1979 Germany ..... 60/302
59-34012 3/1984 Japan .

*Primary Examiner*—Ira S. Lazarus
*Assistant Examiner*—Daniel J. O'Connor
*Attorney, Agent, or Firm*—Foley & Lardner

[57] ABSTRACT

A manifold catalytic converter for automotive engines includes a flange provided on a cylinder head of the engine with a plurality of installation openings formed therethrough corresponding to exhaust ports of the engine. Tubes are connected to the installation openings with the other end of each of the tubes being attached to the vessel of the catalytic converter, aligned along a line of installation which is slanted relative the longitudinal direction of the engine so as to reduce transmission of vibrations from the engine to the vessel of the catalytic converter in directions transverse to the axial direction of the engine.

50 Claims, 6 Drawing Sheets

MANIFOLD TYPE CATALYTIC CONVERTER ARRANGEMENT

BACKGROUND OF THE INVENTION

1. Field of The invention

The present invention relates generally to a catalytic converter for an automotive exhaust manifold. Specifically, the invention relates a manifold type catalytic converter arrangement for an internal combustion engine in which shaking and/or oscillation of the converter vessel is reduced.

2. Description of the Prior Art

Catalytic converters for automotive engines which are arranged on an engine manifold are well known. For example, one such conventional catalytic converter arrangement is disclosed in Japanese Utility Model Application (First Publication) 59-34012, explanatory diagrams of which are shown in FIGS. 7 to 9. Referring to FIGS. 7 and 8, it can be seen that such a conventional manifold type catalytic converter 24 (hereinbelow 'converter 24') includes a vessel 27 which is connected to a cylinder head 22 of an engine 21 via a flange 25 and plurality of branch tubes 26.

The flange 25 has installation openings 25A formed therein at positions opposing exhaust ports 23 of the engine 21 and a first end 26A of each of the branch tubes 26 is respectively attached to one of the installation openings 25A of the flange 25.

As may be seen in FIG. 9, the vessel 27, which is rounded in cross-section, has a curved deflection surface portion 27B oriented on a side facing the engine 21. Although not shown in the drawings, the vessel 27 accommodates a catalytic carrier for effecting conversion of exhaust gases. Second ends 26B of each of the branch tubes 26 are connected to the vessel 27.

According to the above described conventional arrangement, vibration of the converter 24 in directions transverse to the axial direction of the engine is transmitted to the converter 24, the directions of vibration, or resonance, are shown in FIGS. 7 and 9 by arrows. Further, such vibration is amplified by transmission and thus results in a 'resonance peak' of relatively severe vibration being applied to the vessel 27. It will be noted that, engine vibration, due to piston motion and the like, no matter the direction of the vibration, tends to be transmitted to the converter 24 principally as side to side (i.e. directions transverse to the axial direction of the engine) oscillation. If the lower side of the vessel 27 is anchored to the engine 21 with a suitable stay (not shown), transmission of engine vibration to the converter 24 can be reduced, however, in such a case there is apprehension that engine heating during operation, may lead to deformation and/or cracking of the stay or of the branch tubes 26 of the converter 24. Thus, it has been required that such manifold type catalytic converter arrangements be provided with attachment means which provided secure anchoring of the converter while allowing appropriate movement of the converter 24 for suitably responding to engine vibration.

According to the above described conventional converter, arrangement as may be seen in FIG. 9, since the second ends 26B of the branch tubes 26 are attached to the vessel 27 along an installation line 28 which is straight and parallel to the axial direction of the engine 21, side to side rigidity of the vessel is undermined and it becomes difficult to suppress vibrations transmitted from the engine 21 to the vessel 27, and the amplifying or resonating tendency of such transmission especially when the vehicle operates at higher engine speeds, may damage the converter or converter vessel.

Thus, it has been required to provide a manifold catalytic converter arrangement for an internal combustion engine in which such resonance is effectively suppressed.

SUMMARY OF THE INVENTION

It is therefore a principal object of the present invention to overcome the drawbacks of the prior art.

It is a further object of the present invention to provide a manifold catalytic converter arrangement which may effectively reduce shaking, or vibration, applied to a converter vessel, with simple construction.

In order to accomplish the aforementioned and other objects, a manifold catalytic converter arrangement for an internal combustion engine is provided, comprising: a flange attached to a cylinder head of the engine, the flange having installation openings formed therethrough at locations corresponding to positions of exhaust ports in the cylinder head of the engine, a vessel arranged to one side of the engine and containing therein a catalytic carrier for carrying out catalytic conversion, the vessel having an upper side adapted for being connected to branch tubes of the manifold type catalytic converter along a line of installation which is slanted relative a longitudinal direction of the engine, and a plurality of branch tubes, a first end of each of the branch tubes being connected to a corresponding one of the installation openings of the flange, second ends of the branch tubes being attached to the upper side of the vessel along the slanted line of installation, a number of second ends of the branch tube being greater than two.

According to another aspect of the invention, a manifold type catalytic converter arrangement for an internal combustion engine is provided, comprising: a pair of flanges attached to a cylinder head of the engine, each of the flanges having a pair of installation openings formed therethrough at locations corresponding to positions of exhaust ports in the cylinder head of the engine, a vessel arranged to one side of the engine and containing therein a catalytic carrier for carrying out catalytic conversion, the vessel having an upper side adapted for being connected to branch tubes of the manifold type catalytic converter along a line of installation which is slanted relative to a longitudinal direction of the engine, and two pair of branch tubes, a first end of each of a first pair of the branch tubes being connected to a corresponding one of the installation openings of one of the flanges and a first end of each of a second pair of the branch tubes being connected to a corresponding one of the installation openings of the other of the flanges, second ends of the first and second pairs of branch tubes being attached to the upper side of the vessel along the slanted line of installation grouped in pairs corresponding to the pairing of the branch tubes such that the second ends are attached to the upper side arranged such that two second ends of each pair of branch tubes are closer to each other than to a second end of a branch tube of an adjacent pair.

DESCRIPTION OF THE PREFERRED EMBODIMENT

Figure 1:
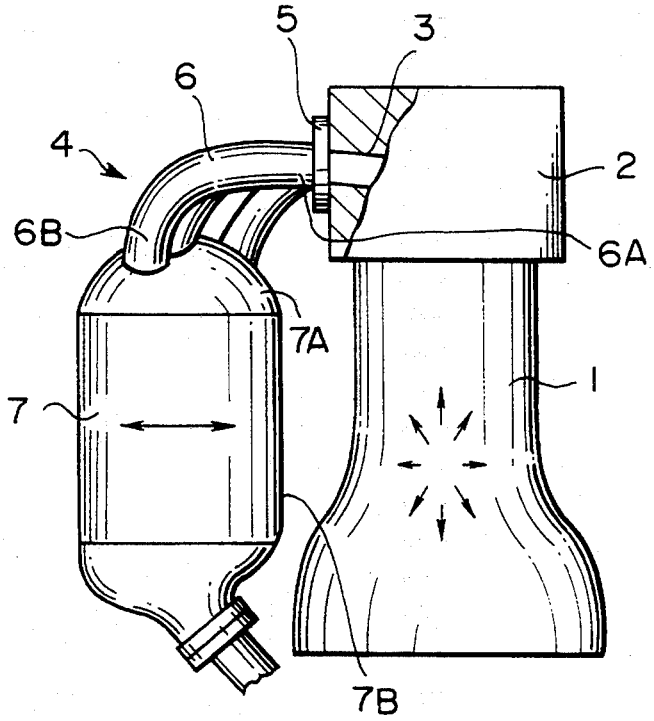
FIG. 1 is a front view of a manifold type catalytic converter arrangement according to a preferred embodiment of the invention.
Figure 2:
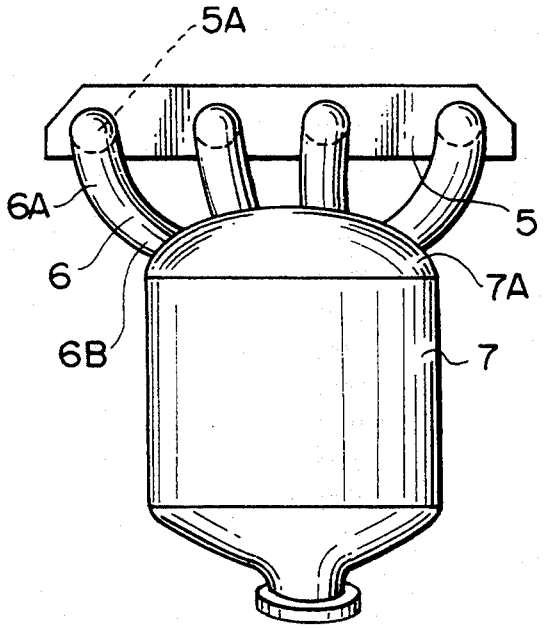
FIG. 2 is a side view of the catalytic converter of FIG. 1.
Figure 3:
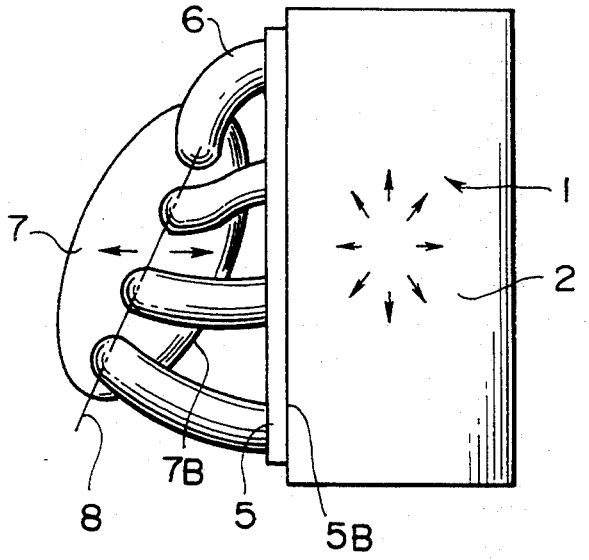
FIG. 3 is a plane view of the catalytic converter of FIG. 1.

Referring now to the FIGS. 1-3, a preferred embodiment of a manifold type catalytic converter arrangement according to the invention is shown. As may be seen in the drawings an internal combustion engine 1 has a cylinder head 2 in which are formed a plurality of exhaust ports 3. On a side surface of the cylinder head 2 a manifold type catalytic converter 4 is attached. The manifold type catalytic converter 4 includes a flange 5, a plurality of branch tubes 6 and a vessel 7.

As may be seen in FIG. 2, the flange 5 has installation openings 5A formed therein at positions corresponding to each of the exhaust ports 3 of the cylinder head 2. A first end 6A of each branch tube 6 is respectively attached to one of the installation openings 5*a* in an 'in line' arrangement.

Although not shown in the drawings, the vessel 7 contains a catalytic carrier similarly to the conventional arrangement and is formed with a substantially rounded, or oval cross section with a curved deflecting surface portion 7B formed at one side thereof arranged facing the engine 1. A top side of the vessel 7 has a substantially dome-shaped cap 7A having openings (not shown) formed therein. Second ends 6B of the branch-/tubes are attached to the openings formed in the cap 7A of the vessel 7 so as to connect between the exhaust ports 3 of the cylinder head 2 and the interior space of the vessel 7.

Figure 8:
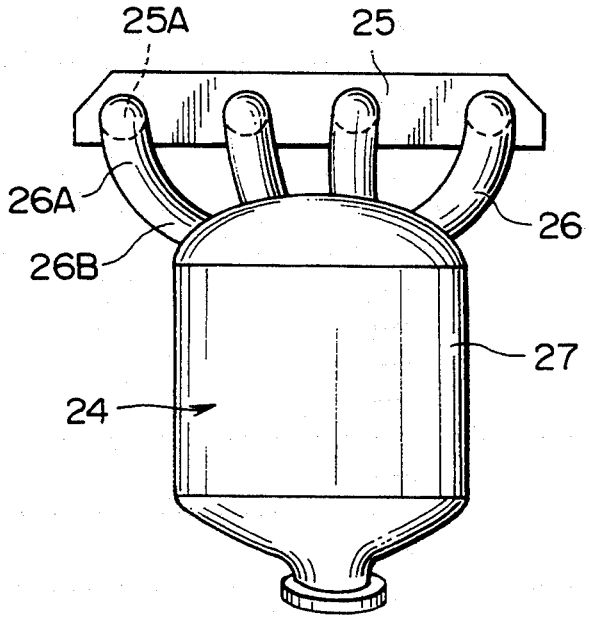
FIG.8 (PRIOR ART)
FIG. 8 is a side view of the conventional manifold type catalytic converter arrangement of FIG. 7.
Figure 9:
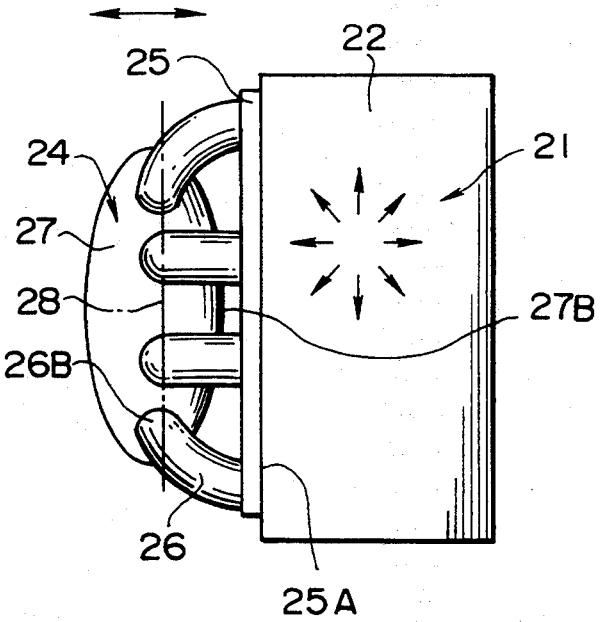
FIG.9 (PRIOR ART)
FIG. 9 is a plane view of the conventional manifold type catalytic converter arrangement of FIG. 7.

Referring to FIG. 3 wherein the directions of resonance are shown by arrows, it may be seen that an installation line 8 (the dot dash line of FIG. 8) is arranged to be slanted relative a longitudinal axis of the engine 1. According to this, when engine vibrations in directions transverse to the axial direction of the engine are transmitted through the cylinder head 3, the flange 5 and the branch tubes 6 to the vessel 7, since the second ends 6B of the branch tubes 6 are arranged along the slanted installation line 8, transmission of vibration is reduced and the rigidity of the vessel 7 for resisting excessive vibration is strengthened. The degree of slanting of the installation line may be, for example, 24°-27°, although other angles may also provide the same advantages according to the invention. The plurality of branch tubes 6 arranged between the engine 1 and the vessel 7 reduce amplification of the vibrations transmitted from the engine 1. It will be noted that, according to the above-described first embodiment, the second ends 6B of each of the branch tubes 6 may be equidistantly arranged along the installation line 8.

It will further be noted that such an arrangement as described above which reduces transmission of engine vibrations to the manifold type catalytic converter 4 is also effective to prevent cracking or deformation of the branch tubes 6 and thus an overall durability of the manifold type catalytic converter 4 is improved.

Hereinbelow, a second embodiment of the present invention will be described with reference to FIG. 4.

Figure 4:
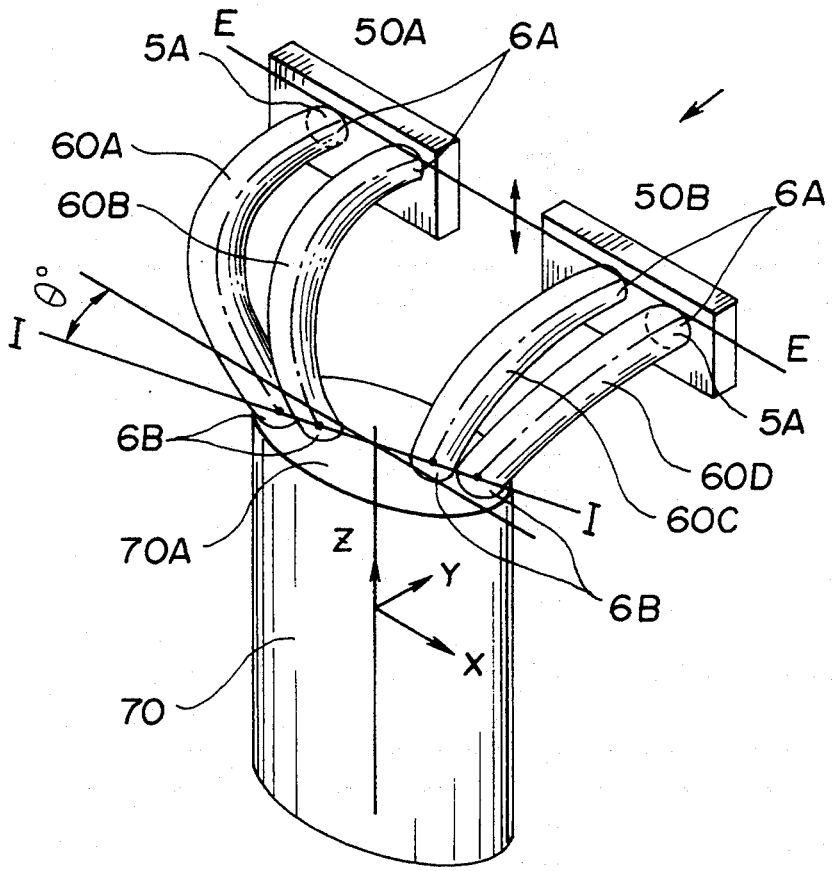
FIG. 4 is a perspective view of a second embodiment of a manifold type catalytic converter according to the invention.

Referring to FIG. 4 it may be seen that, according to the manifold type catalytic converter of the second embodiment that a pair of flanges 50A and 50B are provided which are attached to a side surface of the cylinder head 2 similarly to the previously described embodiment. Each of the flanges 50A and 50B has installation openings 5A formed therein at positions corresponding to exhaust ports 3 of the cylinder head 2 (not shown in FIG. 4).

As may also be seen in FIG. 4, the branch tubes 60A, 60B, 60C, 60D, of the second embodiment are grouped in pairs. First ends 6A of each of the first pair of branch tubes 60A, 60B, are respectively attached to the installation openings 5A, 5A of the first flange 50A, while first ends 6A of each of the second pair of branch tubes 60C, 60D, are respectively attached to the installation openings 5A, 5A of the second flange 50B. It will be noted that the first and second flanges 50A and 50B are installed along an axial line E which is equivalent to the longitudinal axis of the cylinder head, which, according to the present embodiment, may be the same as the longitudinal axis of the engine 1.

Similarly to the first embodiment, second ends 6B of the branch tubes 60A-60D are arranged along an installation line I which is slanted relative the axial line E. However, according to the present embodiment, the second ends 6B of each of the branch tubes 60A-60D are attached to a cap portion 70A of a vessel 70 arranged in pairs, such that two second ends 6B, 6B of the first pair of branch tubes 60A, 60B, are closer to each other than to the second ends 6B, 6B of the adjacent pair of branch tubes 60C, 60D, as may be clearly seen in FIG. 4. It will also be noted that, according to the present embodiment, the second ends 6B, 6B of each pair are attached to the cap portion 70*a* of the vessel 70 proximate a peripheral edge of the cap portion 70A with a substantially wide spacing provided between each pair.

Further, according the the second embodiment, the installation line I is slanted relative the axial line E by and angle Θ, which may be equal to 15°, for example. Also according to this embodiment, the slanted installation line I may taper to converge with the axial line E of the engine. Further, as in the above-described first embodiment, the plurality of branch tubes 60A-60B arranged between the engine 1 and the vessel 70 reduce amplification of the vibrations transmitted from the engine.

Figure 5:
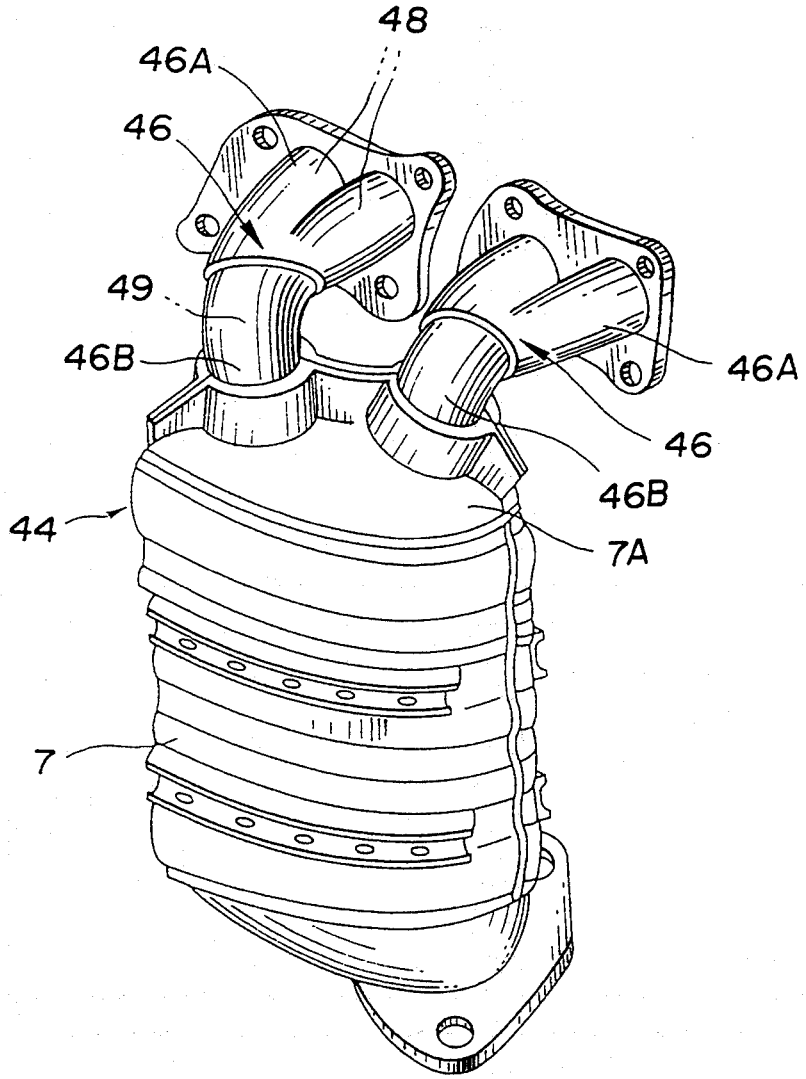
FIG. 5 is a perspective view of a third embodiment of a manifold type catalytic converter according to the invention.

Referring now to FIG. 5, according to a third embodiment of a manifold type catalytic converter 44 according to the invention, the advantages offered by the present invention may be obtained with as few as two branch tubes in a Y-shaped arrangement. It is noted that the arrangement of FIG. 5, a pair of branch tubes 49 have four first ends 48 forming part of a Y-branch portion 46A, and two second ends 46B which are connected along a slanted line of installation to a cap portion 7A of the vessel 7. It is also possible to reverse this structure, such that the branch tubes 49 have two first ends connected to the exhaust manifold and four second ends installed along the slanted line of installation on the converter vessel 7.

Also, according to the invention, as many as six, or eight branch tubes may be connected along the slanted line of installation of the converter vessel 17, so long as at least two branch tube second ends are connected to the vessel.

As best seen in FIG. 4 axial directions X (i.e. in the axial direction of the engine), Y (i.e. transverse to the axial direction of the engine) and Z (i.e. upward and downward) are indicated. These indicate axes along which vibration of the vessel 7 may occur and apply to both of the above-described first and second embodiments.

Figure 6:
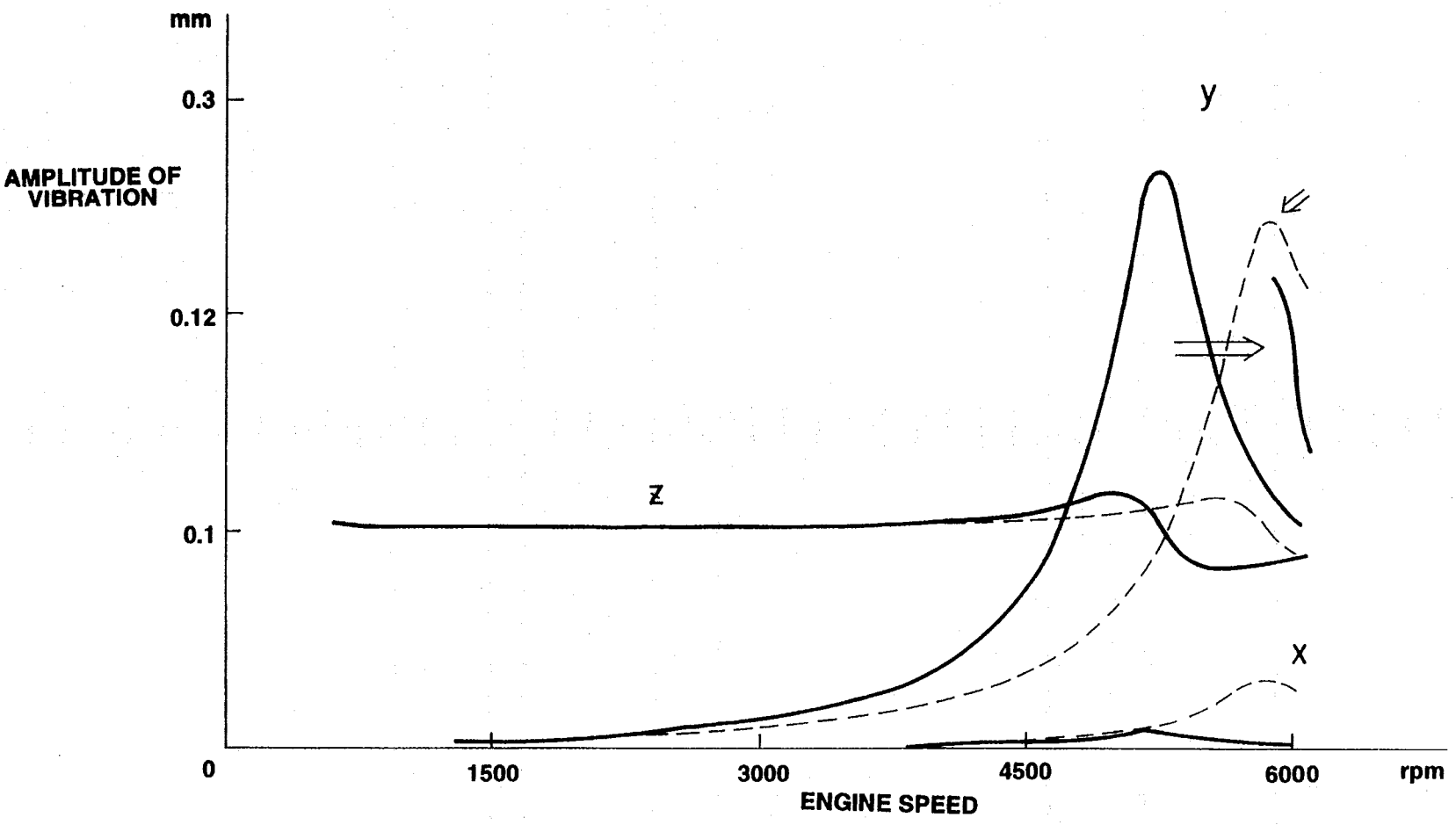
FIG. 6 is a graph comparing vibration in the catalytic converter according to the invention with that in a conventionally installed converter.
Figure 7:
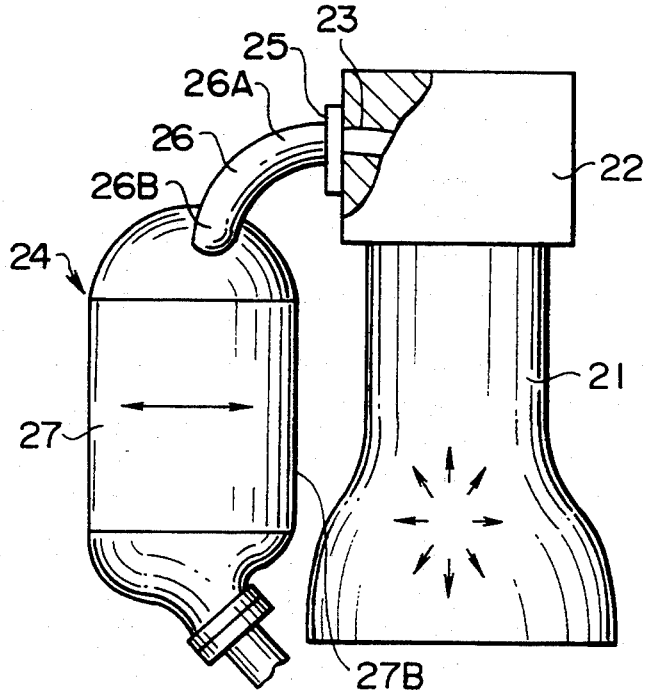
FIG.7 (PRIOR ART)
FIG. 7 is a front view of a conventional manifold type catalytic converter arrangement for automotive engines.

Referring now to FIG. 6, a graph is shown in which vibration characteristics in each of the axial directions X, Y and Z for the above-described embodiments are indicated in broken lines and the vibration characteristics in each of the axial directions for the conventional arrangement are indicated in solid lines. As may be seen in FIG. 6, the vibration peak along the Y (left and right) axis is significantly lower for the manifold type catalytic converter arrangement according to the invention than for the conventional type. Further, the vibration peaks are resisted longer such that the peak for the invention occurs substantially later than for the conventional arrangement.

It will be noted that the vibration peaks along each of the X, Y and Z axes for the arrangement according to the invention do not occur until an engine speed of approximately 6000 RPM is present. This is substantially higher than a normal running speed for typical automotive engines, for example, which usually run at speeds below 5000 RPM. Thus, according to the arrangement of the second embodiment, damaging vibrations in left and right directions are reduced, transmission thereof is efficiently suppressed and the rigidity of the vessel 70 for resisting excessive vibration is enhanced.

The main object of the invention is to suppress resonance in the Y direction, which is directions transverse to the axial direction of the engine, which have the highest resonance peak and which are the most potentially damaging to the converter 1. It will be noted that, when a vehicle runs along long slopes or other adverse driving environments, the engine speed may exceed the normal maximum engines speed and thus, such parallel mount conventional catalytic converters are subject to much higher vibrations and resonance peaks, and are thus much more susceptible to damage, than converters mounted according to the arrangement of the invention.

The inventors of the present invention have established through experimentation and computer simulation that, as the angle of the line of installation of the converter vessel 7 becomes larger, the maximum resonance, or vibration, of the vessel is displaced toward higher engine rotational speed ranges. Thus, as seen in FIG. 6, though the resonance peak in the Y (transverse to the engine axial direction) direction occurs between 5800 and 6000 rpm, as noted above, it is highly unlikely that a typical vehicle, such as a passenger automobile, will run at such engine speeds. Thus, in a catalytic converter according to the invention, substantially no resonance occurs under normal running conditions, and even if the engine is run at a maximum speed of 5000 rpm or greater, vibration applied to the converter vessel will be minimal. Further, according to the invention, the installation angle of the converter vessel may be increased for displacing the resonance peak to an even higher engine rotational speed for assuring that such undesirable resonance will not occur within the operating limits of a given engine.

On the other hand, according to the conventional, parallel arrangement, as also seen in FIG. 6, the resonance peak falls at a lower engine speed and further, an amplitude of vibration is higher than in the arrangement of the invention. Further, the resonance peak of such conventional arrangements falls very close to the maximum speed of operation of a vehicle engine and has a vibration amplitude approximately twice that of the arrangement of the invention.

It will be noted that, according to the present invention, the cross sectional shape of the vessel is not limited to the oval shape of the preferred embodiment, but circular, elliptic, or any other shape of the vessel may also be utilized. Also, although the angle of the installation line I of the first embodiment is 24°–27°, and that of the second embodiment is established as 15°, the invention is not limited to these angles and the advantages of the invention may be realized utilizing an installation line which is slanted at other angles. As noted above, increasing of the angle of the line of installation displaces the resonance peak into a higher engine rotational speed range. Thus the angle of the installation line I may be selected according to a running speed of an engine which is to be equipped with the catalytic converter according to the invention.

Thus, according to the present invention, engine vibration transmitted to a catalytic converter during engine operation is substantially reduced while a necessary amount of movement is afforded to the components such that cracking or damage to the converter is not sustained.

Further, though the preferred embodiments of a manifold type catalytic converter according to the invention are disclosed in terms of mounting on an engine of an automotive vehicle, it will be noted that the invention is active to suppress transmission of engine vibration to a catalytic converter and, as such, may be mounted on any internal combustion engine, even stationary engines utilized as generators, compressors, or the like.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A manifold type catalytic converter arrangement for an internal combustion engine, comprising:

a flange attached to a cylinder head of said engine, said flange having installation openings formed therethrough at locations corresponding to positions of exhaust ports in said cylinder head of said engine;

a plurality of branch tubes, a first end of each of said branch tubes being connected to a corresponding one of said installation openings of said flange, second ends of said branch tubes being attached to an upper side of a vessel and respectively positioned in alignment with each other so as to define a line which is laterally offset from a longitudinal axis of said engine, an offset angle of sail line being selected according to a relation between rotational speed of said engine and vibration resonance applied to said vessel, a number of second ends of said branch tubes being at least two: and a vessel arranged to one side of said engine and containing therein a catalytic carrier for carrying out catalytic conversion, said vessel having an upper side having receiving portions aligned to correspond to positioning of said second ends of said branch tubes.

2. A manifold catalytic converter arrangement as set forth in claim 1, wherein a number of said branch tubes is four.

3. A manifold catalytic converter arrangement as set forth in claim 1, wherein a number of said branch tubes is six.

4. A manifold catalytic converter arrangement as set forth in claim 1, wherein two Y-shaped branch tubes are utilized such that each of said branch tubes has one first end and two second ends.

5. A manifold catalytic converter arrangement as set forth in claim 1, wherein two Y-shaped branch tubes are utilized such that each of said branch tubes has two first ends and one second end.

6. A manifold catalytic converter arrangement as set forth in claim 1, wherein said vessel is circular in cross section.

7. A manifold catalytic converter arrangement as set forth in claim 1, wherein said vessel is oval in cross section.

8. A manifold catalytic converter arrangement as set forth in claim 1, wherein said laterally offset line of installation is offset at an angle of 24°–27° relative said longitudinal axis of said engine.

9. A manifold catalytic converter arrangement as set forth in claim 1, wherein said laterally offset line of installation is offset at an angle of 15° relative to said longitudinal axis of said engine.

10. A manifold catalytic converter arrangement as set forth in claim 1, wherein said laterally offset line of installation is offset at an angle of 15° relative to a longitudinal axis of said cylinder head.

11. A manifold catalytic converter arrangement as set forth in claim 1, wherein said laterally offset line of installation is offset at an angle of 24°–27° relative to a longitudinal axis of said cylinder head.

12. A manifold catalytic converter arrangement as set forth in claim 1, wherein said laterally offset line of installation tapers to converge with a longitudinal axis of said engine.

13. A manifold catalytic converter arrangement as set forth in claim 1, wherein said engine is installed in a vehicle such that said longitudinal axis of said engine is transverse to a longitudinal axis of said vehicle.

14. A manifold catalytic converter arrangement as set forth in claim 1, wherein said engine is installed in a vehicle such said longitudinal axis of said engine is parallel to a longitudinal axis of said vehicle.

15. A manifold catalytic converter arrangement as set forth in claim 1, wherein said second ends of said branch tubes are equidistantly arranged along said laterally offset line of installation.

16. A manifold catalytic converter arrangement as set forth in claim 1, wherein an angle of said laterally offset line of installation is selected according to a maximum rotational speed of said engine, a resonance peak of vibration applied to said converter being displaced toward higher engine rotational speeds according to increasing of said angle of said laterally offset line of installation.

17. A manifold catalytic converter arrangement as set forth in claim 16, wherein said resonance peak defines vibration applied to said converter in directions transverse to an axial direction of said engine.

18. A manifold type catalytic converter arrangement for an internal combustion engine, comprising:

a pair of flanges attached to a cylinder head of said engine, each of said flanges having a pair of installation openings formed therethrough at locations corresponding to positions of exhaust ports in said cylinder head of said engine;

two pair of branch tubes, a first end of each of a first pair of said branch tubes being connected to a corresponding one of said installation openings of one of said flanges and a first end of each of a second pair of said branch tubes being connected to a corresponding one of said installation openings of the other of said flanges, second ends of said first and second pairs of branch tubes being respectively positioned in alignment with each Other SO as to define a line which is laterally offset from a longitudinal axis of said engine, an offset angle of said line being selected according to a relation between rotational speed of said engine and vibration resonance applied to said vessel, said second ends of said first and second pairs of branch tubes being attached to an upper side of a vessel along said offset line and grouped in pairs corresponding to the pairing of the branch tubes such that said second ends are attached to said upper side arranged such that two second ends of each pair of branch tubes are closer to each other than to a second end of a branch tube of an adjacent pair; and a vessel arranged to one side of said engine and containing therein a catalytic carrier for carrying out catalytic conversion, said vessel having an upper side having receiving portions aligned so as to correspond to said positioning of said second ends of said branch tubes.

19. A manifold catalytic converter arrangement as set forth in claim 18, wherein said vessel is circular in cross section.

20. A manifold catalytic converter arrangement as set forth in claim 18, wherein said vessel is oval in cross section.

21. A manifold catalytic converter arrangement as set forth in claim 18, wherein said laterally offset line of installation is at an angle of 15° relative said mounting axis of said engine.

22. A manifold catalytic converter arrangement as set forth in claim 18, wherein said laterally offset line of installation is at an angle of 15° relative a longitudinal axis of said cylinder head.

23. A manifold catalytic converter arrangement as set forth in claim 18, wherein said laterally offset line of installation tapers to converge with said mounting axis of said engine.

24. A manifold catalytic converter arrangement as set forth in claim 18, wherein said engine is installed in a vehicle such that said mounting axis of said engine is transverse to a longitudinal axis of said vehicle.

25. A manifold catalytic converter arrangement as set forth in claim 18, wherein said engine is installed in a vehicle such that said mounting axis of said engine is parallel to a longitudinal axis of said vehicle.

26. A manifold catalytic converter arrangement as set forth in claim 18, wherein said second ends of said first and second pairs of said branch tubes are attached to said upper side of said vessel proximate opposite peripheral edges of said upper side such that a substantial spacing is provided between second ends of said first and second pairs of branch tubes.

27. A manifold catalytic converter arrangement as set forth in claim 18, wherein an angle of said laterally offset line of installation is selected according to a maximum rotational speed of said engine, a resonance peak of vibration applied to said converter being displaced toward higher engine rotational speeds according to increasing of said angle of said laterally offset line of installation.

28. A manifold catalytic converter arrangement as set forth in claim 27, wherein said resonance peak is applied to said converter in directions transverse to an axial direction of said engine.

29. A manifold type catalytic converter arrangement for an internal combustion engine, comprising:

a plurality of branch tubes respectively having first and second end portions, arranged to connect said first ends with exhaust ports of said internal combustion engine and to connect said second ends with said catalytic converter, wherein said second ends of said branch tubes are respectively positioned in alignment with each other so as to define a line which is laterally offset from a longitudinal axis of said engine and/or said exhaust ports, and offset angle of said line being selected according to a relations between rotational speed of said engine and vibration resonance applied to said vessel; and a vessel arranged to one side of said engine and containing therein a catalytic carder for carrying out catalytic conversion, said vessel having an upper side having receiving portions aligned so as to correspond to said positioning of said second ends of said branch tubes.

30. A manifold catalytic converter arrangement as set forth in claim 29, further comprising a flange attached to a cylinder head of said engine, said flange having installation openings formed therethrough at locations corresponding to positions of exhaust ports in said cylinder head of said engine, wherein said first end portions of said plurality of branch tubes are respectively connected to one of said installation openings of said flange and said second end portions of said branch tubes are attached to said vessel.

31. A manifold catalytic converter arrangement as set forth in claim 29, wherein said plurality of branch tubes comprises four branch tubes.

32. A manifold catalytic converter arrangement as set forth in claim 29, wherein said plurality of branch tubes comprises six branch tubes.

33. A manifold catalytic converter arrangement as set forth in claim 29, wherein Y-shaped branch tubes are utilized such that each of said branch tubes has one first end portion and two second end portions.

34. A manifold catalytic converter arrangement as set forth in claim 29, wherein Y-shaped branch tubes are utilized such that each of said branch tubes has two first end portions and one second end portion.

35. A manifold catalytic converter arrangement as set forth in claim 29, wherein said vessel has a circular cross section.

36. A manifold catalytic converter arrangement as set forth in claim 29, wherein said vessel has an oval cross section.

37. A manifold catalytic converter arrangement as set forth in claim 29, wherein said laterally offset line of installation is Offset at an angle of 24°–27° relative to said longitudinal axis of said engine and/or said exhaust port.

38. A manifold catalytic converter arrangement as set forth in claim 29, wherein said laterally offset line of installation is offset at an angle of 15° relative to said longitudinal axis of said engine and/or said exhaust port.

39. A manifold catalytic converter arrangement as set forth in claim 30, wherein said laterally offset line of installation is offset at an angle of 15° relative to a longitudinal axis of said cylinder head.

40. A manifold catalytic converter arrangement as set forth in claim 30, wherein said laterally offset line of installation is offset at an angle of 24°–27° relative to a longitudinal axis of said cylinder head.

41. A manifold catalytic converter arrangement as set forth in claim 29, wherein said laterally offset line of installation tapers to converge with a longitudinal axis of said engine.

42. A manifold catalytic converter arrangement as set forth in claim 29, wherein said engine is installed in a vehicle such that said axial line along which said engine and/or said exhaust port is mounted is transverse to a longitudinal axis of said vehicle.

43. A manifold catalytic converter arrangement as set forth in claim 29, wherein said engine is installed in a vehicle such that said axial line along which said engine and/or said exhaust port is mounted is parallel to a longitudinal axis of said vehicle.

44. A manifold catalytic converter arrangement as set forth in claim 29, wherein said second end portions of said branch tubes are equidistantly arranged along said laterally offset line of installation.

45. A manifold catalytic converter arrangement as set forth in claim 29, wherein an angle of said laterally offset line of installation is selected according to a maximum rotational speed of said engine, and wherein a resonance peak of vibration applied to said catalytic converter is displaced toward higher engine rotational speeds by increasing said angle of said laterally offset line of installation.

46. A manifold catalytic converter arrangement as set forth in claim 45, wherein said resonance peak defines vibration applied to said catalytic converter in directions transverse to an axial direction of said engine.

47. A manifold catalytic converter arrangement as set forth in claim 29, further comprising a pair of flanges attached to a cylinder head of said engine, each of said flanges having installation openings formed therethrough at locations corresponding to positions of exhaust ports in a cylinder head of said engine, at least one of said first end portions of said branch tubes being connected to a corresponding one of said installation openings of one of said flanges and the other first end portions of said branch tubes are connected to a corresponding one of said installation openings of the other of said flanges, said second end portions of said branch tubes being attached to said vessel along said laterally offset line of installation and grouped such that said second ends are attached to said vessel and are arranged such that second end portions of said at least one branch tube connected to said one flange of branch tubes are closer to each other than to second end portions of said branch tubes connected to said other of said flanges.

48. A manifold catalytic converter arrangement as set forth in claim 47, wherein first and second pairs of branch tubes, each having one first end portion and one second end portion, are respectively connected to one of said pair of flanges.

49. A manifold catalytic converter arrangement as set forth in claim 48, wherein said second ends of said first and second pairs of said branch tubes are attached to an upper side of said vessel at opposite peripheral edges of said upper side such that a substantial spacing is provided between second ends of said first and second pairs of branch tubes.

50. A manifold catalytic converter arrangement as set forth in claim 45, wherein said resonance peak is applied to said catalytic converter in directions transverse to an axial direction of said engine.

* * * * *